United States Patent [19]

Garcia et al.

[11] Patent Number: 4,903,347

[45] Date of Patent: Feb. 27, 1990

[54] AUTOMATED CLEANSING APPARATUS ADAPTABLE TO A COMMODE

[76] Inventors: Gilbert C. Garcia, 163 Tabard Dr., San Antonio, Tex. 78213; Rodolfo G. Valdes, 11011 Reverie La., San Antonio, Tex. 78216

[21] Appl. No.: 52,720

[22] Filed: May 20, 1987

[51] Int. Cl.[4] ..... A47K 3/20; E03D 7/08

[52] U.S. Cl. ..... 4/420.4

[58] Field of Search ..... 4/420.1–420.5, 4/443–448

[56] References Cited

U.S. PATENT DOCUMENTS

| | | | |
|---|---|---|---|
| Re. 28,405 | 5/1975 | Sollerud . | |
| 1,521,892 | 1/1925 | Koppin | 4/420.4 |
| 1,752,782 | 4/1930 | Burton | 4/448 |
| 1,957,625 | 5/1934 | Brannan . | |
| 1,962,014 | 6/1934 | Guidetti | 4/420.4 |
| 2,427,953 | 9/1947 | Fishko | 4/444 |
| 2,872,687 | 2/1959 | Maurer . | |
| 3,154,793 | 11/1964 | Congdon | 4/420.2 |
| 3,247,524 | 4/1966 | Umann . | |
| 3,995,326 | 12/1976 | Umann | 4/447 |
| 4,141,091 | 2/1979 | Pulvari . | |
| 4,237,560 | 12/1980 | Riegelman et al. . | |
| 4,340,980 | 7/1982 | Fushimi et al. | 4/448 |
| 4,389,738 | 6/1983 | Ando et al. . | |
| 4,441,219 | 4/1984 | Epstein . | |
| 4,598,431 | 7/1986 | Nagai et al. | 4/420.2 |
| 4,628,548 | 12/1986 | Kurosawa et al. | 4/443 X |

OTHER PUBLICATIONS

Aqua-Aire International, Collected Brochures.

*Primary Examiner*—Charles E. Phillips
*Attorney, Agent, or Firm*—Cox & Smith Incorporated

[57] ABSTRACT

Addressing primarily the needs of physically incapacitated individuals, this invention is a device connected to a common toilet for aiding such individuals in their cleansing of their private body parts with an apparatus that has a unique seat that seals fluids beneath the body of the user. The apparatus is basically an automatic cleansing device that one can connect to a toilet for spraying a warm water-soap solution followed by the spray of a warm water rinsing fluid and completed with the automatic flushing of the toilet as well as the blowing of heated air across the user's private body parts for drying the private body parts; this device is controlled in a variety of ways including electric switches, timers, or other manually operated mechanisms.

15 Claims, 6 Drawing Sheets

AUTOMATED CLEANSING APPARATUS ADAPTABLE TO A COMMODE

BACKGROUND OF THE INVENTION

The present invention relates generally to an automatic body-part cleansing apparatus for cleansing the body surface of fecal matter and urine while the user is positioned to utilize a toilet, and more particularly an automatic cleansing apparatus for such an application which apparatus includes means for systematically spraying cleansing and rinsing fluids and subsequently blowing warm air onto the appropriate body surface.

The nature of the human excretory process presents a fundamental situation that virtually all humans must deal with—that of cleansing the body surface of waste material after its elimination from the body. While many humans resort to the use of toilet tissue to deal with the situation, others, such as physically impaired persons, have difficulty utilizing toilet tissue for this purpose without substantial assistance from another individual. Many individuals who are able to perform the cleansing function with toilet tissue would also prefer not to for reasons such as personal hygiene and personal preference. Alternatives to cleansing with toilet tissues have thus been sought.

Therefore, even for a fully capacitated individual, as the natural excretory process are usually performed while seated on a toilet, cleansing of an individual's crotch area while the individual is positioned in ordinary relation with the toilet seat is a desirable function, particularly after the individual has utilized the toilet for defecation. Beyond the use of toilet tissue for achieving this function, the prior art has utilized a variety of apparatuses. However, as will be partially discussed herein, the teachings of the prior art have limitations and the present invention provides solutions for overcoming many of those limitations.

For an incapacitated individual such as a quadrapalegic, the cleansing of private body parts, the flushing of a toilet and even the utilization of a toilet (including particularly the containment of urine within the toilet bowl by a male) may be difficult if not impossible. Such incapacitation is not confined to specific age groups and, thus, even a person in the prime of his life may require assistance from another person to accomplish these simple but extremely private functions. As a result, emotional and psychological struggles are commonly encountered by such incapacitated persons. These containments, cleansing and flushing tasks are extremely personal and can be embarrassing, to say the least, for a person who must rely on another to perform such tasks. Practically, such assistance also creates difficult situations for other individuals who live with and must accordingly assist incapacitated individuals. These problems often cause emotional and psychological turmoil to an incapacitated individual since such a person often feels to blame for the inconvenience of others around him. The emotional strain of such feelings of guilt and embarrassment ingrain and heighten the unavoidable feelings of inadequacy and often materialize into other physical ailments such as constipation.

Perhaps the most common type of the alternatives to toilet tissue is that which employs a means for spraying liquid onto body parts of a toilet user. This type of apparatus is evidenced in the following U.S. Patents:

Epstein, U.S. Pat. No. 4,441,219; Ando, U.S. Pat. No. 4,389,738; and Brannon, U.S. Pat. No. 1,957,625.

However, the apparatuses of these patents which utilize the spraying of liquid onto the body parts are limited in their effectiveness due to the spaced relationship between the nozzle for such spraying and the target body parts. Due to the obvious necessity of positioning such nozzles at locations where they would not likely be in contact with the human excretions during the excretory process, previous apparatuses have resorted to positioning such nozzles at locations near the perimeter of the toilet bowl. This positioning limits the cleansing effectiveness of the nozzles since it would be optimized at positions immediately adjacent the target body surfaces. Although Sollerud, U.S. Pat. No. Re28,405, discloses a handheld apparatus with nozzles positionable immediately adjacent a patient's flesh for hygenically washing the patient, nozzles similarly positionable are not known in the prior art of record to be incorporated with an automatic cleansing apparatus which is connectable to a toilet.

Additionally, means for controlling such apparatus are advantageous. Previous apparatuses including that of Epstein and that of Ando, have employed means for cleansing private body parts which are controlled by operating switches or buttons, while Pulvari, U.S. Pat. No. 4,141,091, has addressed the control problem associated with actuating the flushing of excretions from a toilet bowl by employing means which does so in correspondence with approach and departure of a user of the apparatus.

The prior art represented by the apparatus of Brannon and that of Ando teaches means for cleansing parts of the human body by streaming warm water and air from stationary ports onto the body; however, since the human body varies from individual to individual with each individual having parts of their body positioned at slightly different locations with respect to the toilet, the streaming of solutions from stationary ports can be inaccurately directed such that the spray might miss the appropriate body parts of some individuals. Thus, it is another object of the present invention to provide a means for cleansing the perianal regions of human bodies regardless of natural variations between individuals of the positioning of the anus with respect to on the seat of a toilet when such individuals are seated on a toilet.

Additionally, it is an object of the present invention to provide a seat for a mountable toilet apparatus which seals fluids within the space of the toilet bowl beneath an individual using the toilet.

Furthermore, it is also an object of the present invention to provide an automatic cleansing apparatus which is operable by incapacitated individuals and which is mountable in a comfortable, compact form on a common toilet.

Other objects, features and advantages of the invention will become evident in light of the following detailed description considered in conjunction with the referenced drawings of a preferred exemplary automated cleansing apparatus adaptable to a commode according to the present invention.

SUMMARY OF THE INVENTION

The present invention provides an automatic apparatus mountable on a common toilet, for directing fluids onto the crotch of the body of a person utilizing the apparatus. This fluid direction is primarily for enabling cleansing of the user's crotch area after defecation but may also be employed for other advantages such as for enabling a douche, enabling an enema, applying medications, or other purposes that are enabled by the direction of fluid onto the user's crotch area while the user is seated on a toilet. Uniquely, the present invention accomplishes these body caring functions by providing means for directing fluid onto the user's crotch area, which directing means are pivoted to within close proximity of the user's crotch. Controlling mechanisms may control this fluid direction to automatically cleanse, rinse and dry the user's body parts while the user is seated on a seat specifically adapted for sealing fluid from passing upward beyond the user's crotch area.

For the purposes of this application, crotch or crotch area is taken to include the perianal region and external genitalia of both sexes and, in the female, the periurethral region.

By pivoting nozzles for directing cleansing, rinsing and drying fluids onto the user's body parts, the present invention improves the advantages of such fluid spraying by minimizing the distance between the nozzles and the body parts. The nozzles may be positioned away from view, beneath the seat of the apparatus of the present invention, until the user desires to cleanse the body parts. This out-of-sight positioning not only minimizes anxieties and embarrassment to the user, which are common when a handicapped user is confronted with viewing special adaptions (such as the pivoting nozzles) that are necessary for dealing with his handicap, but this positioning also minimizes the likelihood that the nozzles would come in contact with excretions during users' excretory processes. Then, when the cleansing function of the present invention is desired, the controls may be operated to control the pivoting of the nozzles to positions directly beneath the user's crotch area.

Means including special motors and springs are also included in the preferred embodiment of the present invention for biasing the nozzles in the out-of-sight positions beneath the seat. The motors which pivot the nozzles beneath the user's crotch area are such that the rotation of such motors will only stop in positions corresponding to the out-of-sight positions of the nozzles beneath the seat, regardless of when the empowering electricity of such motors is disconnected during the rotation of such motors.

The movement of the nozzles with respect to the user's private body parts also enhances the cleansing action of fluid sprayed from the nozzles when the apparatus is utilized for cleansing purposes. This enhanced cleansing action is the result of the surge-like application of the fluids onto the user's private body parts, which surge-like application is accompanied by enhanced dislodging of foreign particles on the user's surface.

Although the specific locations of user's relevant body parts with respect to the toilet seat varies from user to user, these are usually variations along the center of lateral symetry of the seat since the human body is laterally symetrical while the shape of a toilet seat tends to align the line of symetry of the user's body along with the line of symetry of the toilet seat. Further, as nozzles of the embodiments of the present invention are pivoted beneath the user's crotch area through a path which has only a slight arc and which is thus approximately linear, the relevant body parts of almost all potential users would be located at positions beneath which the nozzles of the present invention pivot. This arc of the nozzles' path remains slight since the cleansing and rinsing nozzles are pivoted about a vertical axis laterally outside the perimeter of the toilet. Since the radius of curvature of the nozzles paths are accordingly larger than a similar path would be if the nozzles were pivoted about an axis within the perimeter of the toilet, the arcs of the paths of the rinsing and cleansing nozzles are only slight. The location of the pivotal axis of the rinsing and cleansing nozzles laterally to the side of an ordinarily positioned user enables the slightly curved paths of the rinsing and cleansing nozzles to approximate a straight path directly beneath the the user's body and in the same plane as the body's axis of symetry. On the other hand, experience has shown that the proximity of a nozzle for blow-drying the user's body parts is not as crucial as the proximity of the rinsing and cleansing nozzles. A nozzle for blowing heated air onto the user's body surface, thus, is pivoted beneath the user's crotch area about a vertical axis to the rear of the seat on which the user is ordinarily positioned.

A control box controls the operation of the preferred embodiment of the present invention. This control box systematically controls the flow of cleansing, rinsing and blow-drying fluids through the respective cleansing, rinsing and blow-drying nozzles while also controlling the pivotal movements of these nozzles to provide a maximally effective cleansing operation of an apparatus of the present invention. This operation also includes controlling a means for actuating the flushing of the excretion receiving chamber of the toilet in order to flush the excretions and previously utilized cleansing and rinsing fluids from the excretion receiving chamber. This maximally effective operation is ideal and sequentially includes: the generation of a warm water source; the testing of the temperature of the generated warm water source by spraying a portion of spray of the warm water onto a sensitive (but not critically sensitive) part of the user's body; cleansing the user's body by spraying a cleansing fluid from a cleansing nozzle that pivots beneath the user's crotch area; rinsing the cleansing fluid from the user's body surface by spraying a rinsing fluid upwardly onto the user's body from a rinsing nozzle pivoting beneath the user's crotch area; actuating the flushing of the excretion receiving chamber of the toilet; drying the body surface by compressing, heating, and blowing heated air upwardly across the user's crotch area from a blower nozzle while pivoting the blower nozzle beneath the user's crotch area; and ceasing this ideal operation when it is complete. This ideal operation is controlled by the control box with the aid of the user or another person depressing buttons on the control box, and, in an alternative embodiment, by a timer which sequentially controls the individual operations in the ideal operation according to predetermined sequential durations.

In another embodiment, the controls are operated by movement of the user's back. The user's back can operate means which close electrical switches in order to sequentially actuate valves and other electrical components, which valves and other components in turn control the flow of liquids through the embodiment's nozzles. Pivoting of the nozzles beneath the user's crotch area can also be controlled by the user's back through manual controls which translate pivoting movement of the user's back into pivoting movement of the nozzles. Users who do not have the use of their arms can thus control that embodiment's operation. Several other alternative means for performing the functions of the specific components of the preferred embodiment of the present invention further enable manually controlled operation of this alternative embodiment of the present invention. These alternative means include a modified seat as provided with a plurality of blower ports, integrally formed with the seat, for blowing warm air across the user's crotch area; a pressure sensitive switch, incorporated into the seat, for actuating the generation of warm water source when the user is seated on the seat; an electrical connection that is controllable by the user's back to rotate a rotating electrical contact into differing positions, which differing positions enable the closing of differing electrical circuits, which rotating electrical connections may be substituted for other types of electrical switches; and a lever mechanism, manually controlled by the user's back, which disconnects the circuit for generating the warm water source and also which actuates the flushing of the excretion receiving chamber of the toilet.

Additionally, although the prior art has included the spraying of a liquid onto the user's crotch area, the Applicant has improved the cleansing effect of such liquid spraying. By sequentially spraying two liquids—a first, cleansing fluid which is a mixture of warm water and soap, and a second, rinsing fluid which is warm water—the present invention improves the cleansing action enjoyed by the spraying of fluids on the user's private body parts.

The apparatus of the present invention is preferably embodied in a housing that is comfortable and suitable for supporting and containing the apparatus, as well as for supporting the body of the user. This housing includes a seat, which seat itself is advantageous. To begin with, the seat provides a fluid seal for sealing fluids in a space substantially beneath the body of the user. This fluid seal enables thorough cleansing of the user's crotch area since adequate fluids may be sprayed onto the user's crotch area without also spraying onto other parts of the user's body. This fluid seal is also effective for sealing foul gasses associated with the human excretion process within the sealed space until (and after) flushing. A particularly unique aspect of this fluid sealing seat is the inclusion of a cup in the frontal portion of the seat that is positioned and has features for aiding in the containment of urine excreted by a male when such male cannot or chooses not to manually control the direction in which urine is excreted from his penis. Additionally, while heated air is communicated through the seat, the present invention is also provided with means for warming the seat in order to enhance the comfort of use of the apparatus of the present invention.

These and other advantages of the present invention will become evident to those skilled in this art upon a reading of the following detailed description of the invention, which should be taken in conjunction with the accompanying drawings and appended claims.

DETAILED DESCRIPTION OF THE PREFERRED EMBODIMENTS

In the accompanying FIGS. 1 through 4, the elements of an automatic cleansing apparatus adaptable to a commode are shown. It should, of course, be understood that the figures and the following description serve merely to present a clear understanding of the underlying technical details and principles, and that various types of nozzles, controls, retracting means, and other devices could be equally well utilized. The embodiment described is merely for the purpose of illustration.

Figure 2:
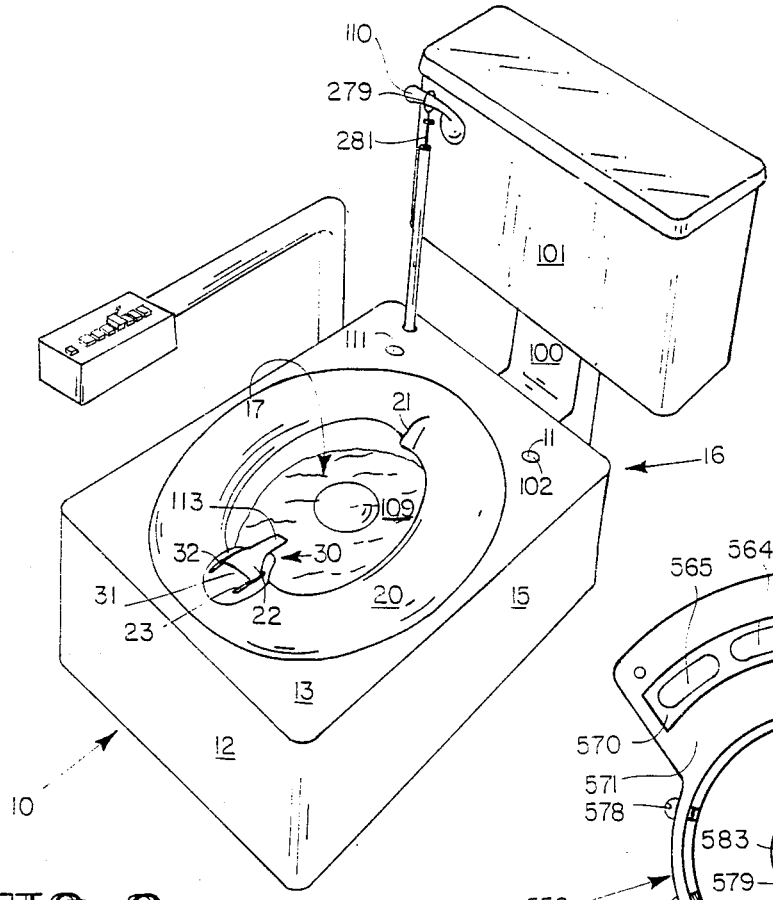
FIG. 2 is a birds-eye perspective view of the apparatus of the present invention as mounted on a common toilet.

Referring to FIG. 2, the present invention is shown in operative relation to a standard toilet 100 having a waste receiving chamber 109 which is flushed by operating a flush handle 110. Flush handle 110 is operatively connected through holding tank 101 to standard means (not shown) for flushing chamber 109. Such standard toilet 100 is also provided with bolts 102 and 111 that are normally utilized for connecting a lid (not shown) upon the standard toilet 100, although the connecting of the embodiment of the present invention requires the removal of such a lid.

Figure 1:
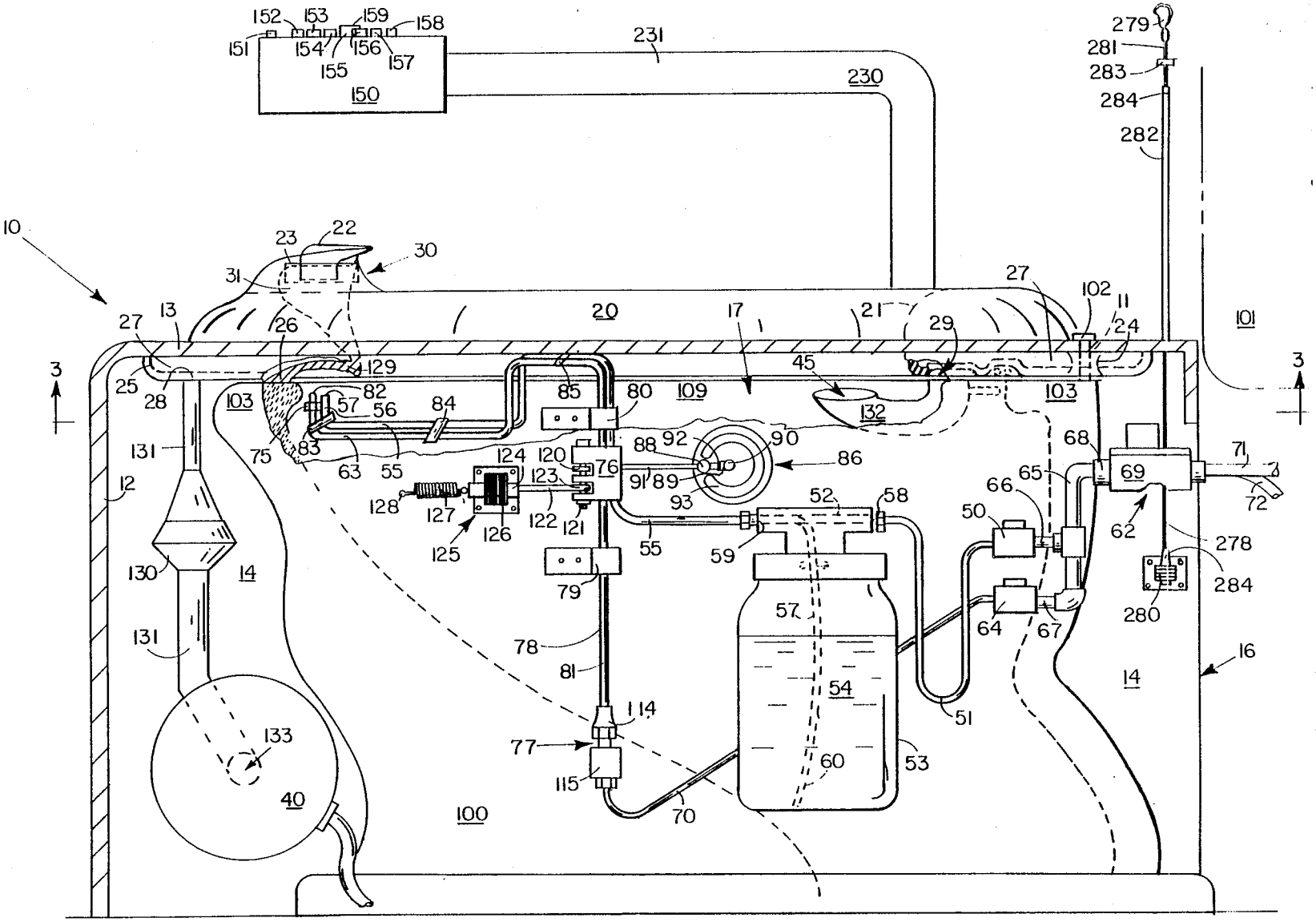
FIG. 1 is a cut-away left side elevation view of the apparatus of the present invention with the housing of the apparatus of the present invention shown cross-sectionally.

With the lid of toilet 100 removed, housing 10 is mountable on standard toilet 100 by securing housing 10 to toilet 100 with bolt 102 through bore 11 (shown in FIG. 1). Housing 10 rests on floor surface 112 and contains and supports most of the embodiment of the present invention. Housing 10 has a box-like shape which is formed by front planar member 12, top planar member 13, right side planar member 14 (shown in FIG. 1) and left side planar member 15 which members 12, 13, 14 and 15 are integrally formed together. Housing 10 has openings at its rear side 15 and at the side adjacent floor 112. An access hole 17 is provided in top planar member 13 for access to the excretion receiving chamber 109 from above top planar member 13. Seat 20 is integrally formed with top planar member 13 and surrounds access 17.

Seat 20 is a seat having a shape basically similar to seats of standard toilets for supporting the body of a person (not shown) who is using the apparatus of the present invention in an ordinary position over access 17, which position of the body is a convenient and comfortable position for enabling the excretion of bodily wastes through access 17. This ordinary position of the body over access 17 is a position which is a typical one in relation to a standard toilet 100 for utilizing standard toilet 100. More particularly, this ordinary position of the body over access 17 is typically characterized as similar to a sitting position with the body's buttocks resting centrally from left to right on seat 20 with the body's back facing holding tank 101.

More particularly, seat 20 is also provided with cleavage seal 21, crotch seal 22, slots 23 and 32, rise 31 and cup 30 (shown in FIG. 1 in hidden lines). Cleavage seal 21 is integrally formed with seat 20 and comprises a ridge-shaped protrusion from the rear of seat 20, which ridge-shaped protrusion has an elongated dimension positioned lengthwise in a substantially vertical position. Cleavage seal 21 has an appropriate shape for conforming to the body of a person seated in an ordinary position on seat 20 with cleavage seal 21 conforming to the rear and upper portion of the person's buttocks cleavage (not shown).

Rise 31 encloses cup 30. Cup 30 communicates with the excretion receiving chamber 109 of toilet 100 even when a person is positioned on seat 20 in an ordinary position with each of the person's legs extending forward to the right and left side of rise 31. Rise 31 is integrally formed with seat 20. Rise 31 is further provided with slot 23 and 32 having elongated dimensions positioned substantially horizontally lengthwise from front 12 to rear 16. Slots 23 and 32 penetrate into seat 20, but slots 23 and 32 do not communicate with cup 30. Pubic seal 22 is slideably engaged with slots 23 and 32 for sliding from front to rear and vice versa. The shape of pubic seal 22 is such that pubic seal 22 seals off a space including excretion receiving chamber of toilet 100 when pubic seal 22 is positioned in its rearmost position within slots 32 and 23 when a person is seated on seat 20 in a normal position. Pubic seal 22 has a shape defined in part by protruding edges 113. Edges 113 form to the upper legs and upper pubic region of the body of a person who is seated on seat 20 in an ordinary position when pubic seal 22 is in its rearmost position within slots 23 and 32.

Thus, when an individual is seated in an ordinary position on seat 20, a substantially sealed space is formed beneath the body of the individual. The substantially sealed space, which comprises excretion receiving chamber 109 is substantially sealingly enclosed by toilet 100, the body of the individual O-ring 26, contoured panel 25, pubic seal 22, cleavage seal 21, rise 31 and the other parts of seat 20. The sealed characteristic of this sealed space is incorporated in the apparatus of the present invention for containing fluids, including humanly excreted fluids as well as fluids for cleansing the body, which might other wise escape.

Referring now to FIG. 1, contoured panel 25, which is rigidly connected to upper planar member 13, rests upon the rim 103 of toilet 100 for additional support of top planar member 13. O-ring like seals 26 are positioned between contoured panel 25 and rim 103 for providing a seal therebetween, which seal retards the flow of liquid or gasses between contoured panel 25 and rim 103. Seal 26 is mounted to contoured panel 25. Contoured panel 25 also encloses a space 27 between contoured panel 25 and upper planar member 13. Space 27 communicates with compressed air source 40 and blower port 45 through ports 28 and 29 respectively. Spacers 24 are rigidly and sealingly connected between upper planar member 13 and contoured panel 25 at bores 11 with bores 11 passing through spacers 24. Spacers 24, thus, prevent gasses from escaping space 27 through bore 11.

A warm water source 62 is provided for the apparatus of the present invention by mixing valve 69. Cold water line 71 and hot water line 72 are sealingly connected with valve 69. When valve 69 is actuated, cold water line 71 enables fluid communication between a pressurized cold water source (not shown) and warm water supply 62. Also, when valve 69 is actuated, hot water line 72 enables fluid communication from a pressurized hot water supply to warm water source 62. The actuation of valve 69 enables the mixing of pressurized cold water received through line 71 with pressurized hot water received through line 72, and this mixing produces a warm water source 62 within valve 69.

Valves 50 and 64 are each actuable by electrical means to provide fluid communication from warm water source 62 to the fluid passages within lines 51 and 70 respectively. Bifurcated fluid conduit 65 enables this fluid communication between warm water source 62 and each of the passages with lines 51 and 70. Valves 50 and 64 are identical with respect to each other and each of valves 50 and 64 have inlets and outlets, each of which inlets receive fluids supplied by warm water source 62. The outlets of valves 50 and 64 communicate with warm water supply 62 only when valves 50 and 64, respectively, are actuated. First bifurcated end 66 of bifurcated fluid conduit 65 is sealingly connected to the inlet of valve 50. Second bifurcated end 67 of bifurcated fluid conduit 65 is sealingly connected to valve 64 at the inlet of valve 64. Source end 68 of bifurcated conduit 65 is sealingly connected to valve 69 for enabling fluid communication with warm water source 62.

A cleansing solution supply system comprises cleansing valve 50, line 51, line mingling cap 52, soap container 53, soap source 54, soap draw line 57, coaxial line 55, and cleansing nozzle 56. Line mingling cap 52 has water inlet 58 and outlet 49 and is threadably engaged with soap container 53. Soap container 53 contains soap source 54. The lower end 60 of soap draw line 57 is submerged within soap source 54. Line 51 is connected between line mingling cap 52 and cleansing valve 50 for enabling communication between water inlet 58 of line mingling cap 52 and a warm water supply 62 provided through cleansing valve 50. Inlet 58 is further in fluid communication with cap outlet 59 for providing communication of warm water from warm water source 62 to outlet 59. Cap outlet 59 is also in fluid communication with soap source 54 through soap draw line 57. Line mingling cap 52 mingles soap draw line 57 with the water communication between inlet 58 and outlet 59 while line mingling cap 52 maintains the integrity of soap draw line 57. This mingling by line mingling cap 52 is such that a coaxial flow is enabled through outlet 59 when valve 50 is actuated to enable fluid communication between warm water source 62 and water inlet 58. This coaxial flow through outlet 59, while valve 50 is thus actuated, is, in part, comprised of a stream of water flowing from water inlet 58, which stream of water is, at outlet 59, a stream surrounding soap draw line 57. The coaxial flow through outlet 59 also comprises a stream of soap enclosed by soap draw line 57 and drawn from soap source 54 through soap draw line 57. Coaxial line 55 is connected to line mingling cap 52 at outlet 59.

Additionally, coaxial line 55 contains a coaxial flow which maintains the definition of the coaxial flow through outlet 59. Coaxial line 55 has an outer line (not numbered) and an inner line (not shown), each outer and inner line being approximately coaxial with respect to the other. Coaxial line 55 is flexible. There is a fluid passage in between the outer line and the inner line of coaxial line 55. The connection between coaxial line 55 and line mingling cap 52 at outlet 59 is such that the inner line of coaxial line 55 is connected to soap draw line 57 in a manner that provides fluid communication of the liquid within soap draw line 57 to that within the inner line of coaxial line 55. The connection between coaxial line 55 and line mingling cap 52 at outlet 59 also enables fluid communication from water inlet 58 to the fluid passage between the outer line and inner line of coaxial line 55.

Coaxial line 55 is formed to and connected in substantially fixed relation with arm 63. Coaxial line 55 has a nozzle 56 wherein the soap stream within the inner line of coaxial line 55 communicates and mixes with the water stream in the fluid passage between the outer and inner lines of coaxial line 55. In operation with water valve 50 actuated to enable fluid communication between water inlet 58 and warm water source 62, warm water flows between the outer line and the inner line of coaxial line 55 and upon flowing into nozzle 56, this warm water enabled by the actuation of valve 50 draws the liquid soap from the inner line of coaxial line 55, and the warm water in nozzle 56 mixes with the soap drawn into nozzle 56 for providing a soap-water mixture within nozzle 56. This soap-water mixture within nozzle 56 is dispensed upwardly from nozzle 56 through port 57. The soap to water ratio of the soap-water mixture dispensed from nozzle 56 is determined by the characteristics of nozzle 56, which characteristics determine the pressure that draws soap from the inner line of coaxial line 55.

The temperature of the soap drawn from the inner line of coaxial line 55 is affected by the temperature of the water flowing between the inner and outer lines of coaxial line 55. Due to communication of heat through the inner line, the temperature of the soap in the inner line approaches the temperature of the water between the inner line and the outer line. Thus, when the water flowing through coaxial line 55 has a temperature warmer than that of the soap drawn through coaxial line 55, the soap drawn through coaxial line 55 is warmed by the water drawn through coaxial line 55.

A rinsing solution supply system includes valve 64, line 70, pivotal line connection 77, rigid line 78, and rinsing nozzle 75 each of which 64, 70 77, 78 and 75 contains a passage for communicating fluidly with the outlet of rinsing valve 64. Line 70 is sealingly connected to valve 64 for enabling fluid communication from the outlet of valve 64 to the fluid passage enclosed by line 70. Line 70 is also sealingly connected to pivotal line connection 77. Pivotal line connection 77 is connected to rigid line 78 in a manner that enables fluid communication between the passage within line 70 and the passage within rigid line 78. Pivotal line connection 77 has an upper portion 114 and a lower portion 115. The upper portion 114 is pivotally connected to the lower portion 115. Rigid line 78 has a vertical section 81 and an arm section 63. The vertical section 81 is rigidly connected to the upper portion of pivotal line connection 77. Line 70 is rigidly connected to the lower portion of pivotal line connection 77. The lower portion 115 of pivotal line connection 77 is rigidly connected to the left planar member 15 of housing 10. The pivoting of the upper portion 114 of pivotal line connection 77 pivots about a vertical axis, which vertical axis runs centrally in relation to the vertical section 81 of rigid line 78. Rigid line 78 encloses a fluid passage through its total length for enabling fluid communication between the passage within line 70 and the passage space enclosed by rinsing nozzle 75. Rinsing nozzle 75 is rigidly connected to the armature 63 of rigid line 78 in a manner that, likewise, enables fluid communication between the passage space enclosed by rinsing nozzle 75 and the fluid passage through rigid line 78. The passage space within rinsing nozzle 75 communicates with the excretion receiving chamber of toilet 100 through orifice 82.

Thus, when valve 64 is actuated, fluid communication is enabled between warm water source 62 and orifice 82. While this communication is sealed and since the water supplied to warm water source 62 is pressurized, a stream of pressurized water is thus streamed through orifice 82 when valve 60 is actuated in addition to valve 64. Orifice 82 is positioned in relation to nozzle 75 in order to spray the stream of water through orifice 82 in an upward direction.

The S-like shape of rigid line 78 (shown in FIG. 1) enables the positioning of rigid line 78, along with coaxial line 55, over the rim 103 (pertinent portions of which have been cut away in FIG. 1) of toilet 100 and partially within the excretion receiving chamber of toilet 100. This positioning of rigid line 78 is also apparent in FIG. 3. Coaxial line 55 is connected to and positioned in substantially fixed relation with the arm 63 of rigid line 78, which connection is enabled by brackets 83 through 85. Upper pivotal brackets 80 and cam-like lever 76 enable the positioning of coaxial line 55 in substantially fixed relation with the vertical section 81 of rigid line 78 by rigidly connecting the lines 55 and 78 in bracket-like manner. Nozzles 56 and 75 are positioned to spray fluid through port 57 and orifice 82, respectively, upwardly in a substantially vertical direction.

Motor 86 provides means for pivoting nozzles 56 and 75 about the vertical axis of vertical section 81. Crank arm 89 of motor 86 is rigidly connected to shaft 90, while shaft 90 is positioned with the axis of shaft 90 being perpendicular to the plane of FIG. 1, which plane of FIG. 1 is parallel to the right and left planar members 14 and 15. Pin 88 is pivotally connected to crank arm 89, and pin 88 pivots with respect to crank arm 89 about an axis perpendicular to the plane of FIG. 1. Pin 88 has a bore therethrough through which rod 91 is slideably engaged. Detent 92 is rigidly connected to rod 91. Motor 86 is electrically operated to rotate shaft 90, and crank arm 89 thus rotates about the axis of shaft 90 during such electrical operation of motor 86 in a cam-like fashion. The rotation of crank arm 89 further rotates pin 88 over electrical contact 93. Electrical contact 93 is rigidly mounted to housing 10 and is annularly shaped except for a small gap region. Electrical contact 93 is electrically connected to an electrical power source. Pin 88 is electrically connected to the power terminal of motor 86. Pin 88 is in direct electrical communication with contact 93 when pin 88 is rotated about shaft 90 over electrical contact 93. There is no electrical connection between pin 88 and contact 93 when pin 88 is rotated over the gap region.

The electrical mechanism (not shown) of motor 86 that effects the rotating operation of motor 86 includes means for consistently stopping the rotation of crank arm 89 in substantially the same orientation with respect to each other stopping of the rotation of crank arm 89. The electrical mechanism of motor 86 includes a switch which is remotely operated by control box 150. When this switch of the electrical mechanisms of motor 86 is actuated, the electricity in powering the rotating operation of motor 86 ceases when and only when pin 88 is in a position that disables electrical communication between pin 88 and electrical contact 93. This disabling position of crank arm 89 with respect to the axis of shaft 90 is always substantially that shown in FIG. 1. Rod 91 is ordinarily biased, as described further in this description, in a direction along its length away from pin 88 and toward cam-like lever 76.

Figure 3:
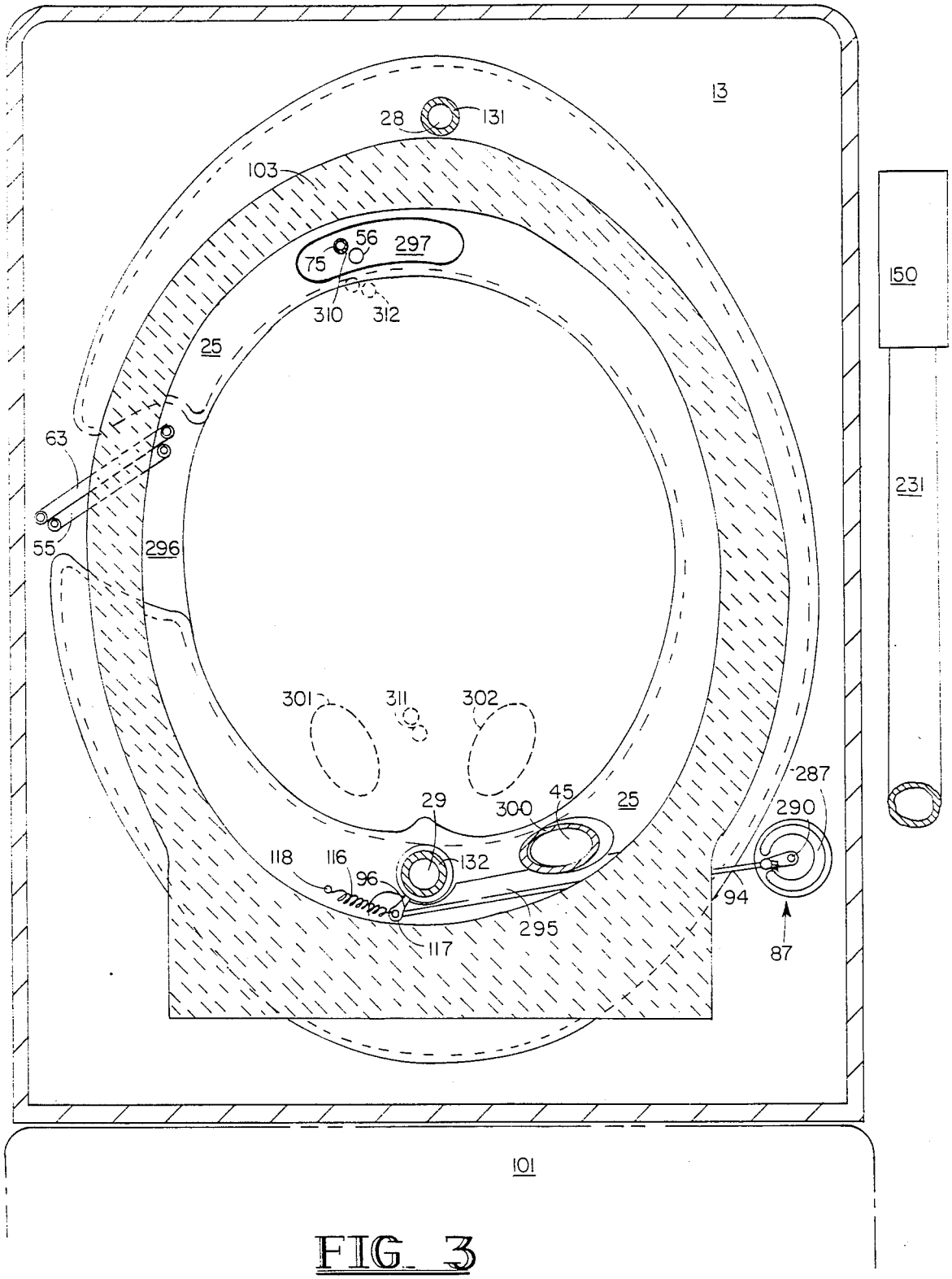
FIG. 3 is a cross-sectional view taken along line 3—3 shown in FIG. 1.

Referring briefly to FIG. 3, pivotal drive motor 87 is virtually identical to pivotal drive motor 86 (shown in FIG. 1). The preceding description of motor 86 and of the operation of motor 86 is, therefore, descriptive of motor 87 and its operation as well, but motor 87 is slidably engaged with rod 94 rather than rod 91 and rod 94 has detent 95 rather than detent 92.

Rod 91 has eyelet 120 integrally formed therewith at the longitudinal end of rod 91 opposite detent 92. Eyelet 120 is pivotally connected to pin 121. Pin 121 is engaged through a vertical bore in cam-like lever 76. Test rod 122 also has an eyelet 123 integrally formed therewith at a first end of test rod 122, which eyelet 123 is pivotally connected to pin 121. Rod 122 is rigidly connected to shaft 124 of solenoid 125. Solenoid 125 is rigidly mounted to housing 10 and coils 126 are rigidly connected to and form an integral part of solenoid 125. A first longitudinal end of extension spring 127 is rigidly connected to shaft 124 of solenoid 125 at the end of shaft 124 opposite test rod 122. The second longitudinal end of spring 127, which second longitudinal end is opposite the first longitudinal end, is rig idly connected to housing 10 at spring connection 128. Spring 127 is a helical extension spring which biases shaft 124 of solenoid 125 toward spring connection 128. Solenoid 125 is electrically actuated. During actuation of solenoid 125, shaft 124 is biased away from spring connection 128. Solenoid 125 is of an ordinary type for effecting such actuation through use of electricity. Thus, upon actuation of solenoid 125, test rod 122 is biased in a position away from spring connection 128. When solenoid 125 is not actuated, spring 127, thus, biases test rod 122 in a position toward spring connection 128.

Upper pivotal bracket 80 and lower pivotal bracket 79 are mounted to the left planar member of housing 10. Vertical section 81 of rigid line 78 is pivotally engaged with pivotal bracket 79 and 80 to enable the pivoting of vertical section 81 about the vertical axis of vertical section 81. Cam 76 is rigidly connected to rigid line 78, and cam-like lever 76 is, therefore, able to pivot about the vertical axis of vertical section 81. Likewise, the armature 63 of rigid line 78 pivots about the vertical axis of vertical section 81.

As test rod 122 is biased in a position toward spring connection 128, rod 91 is also biased by extension spring 127 toward spring connection 128. Another extension spring (not shown) is also connected between arm 63 and housing 10 for further improving the spring bias of test rod 122 in a position toward spring connection 128 while likewise biasing armature 63 in the position 310 (shown in FIG. 3). During operation of motor 86, motor 86 translates rod 92 substantially along the length of rod 91 in an oscillatory manner while the detent end of rod 91 is rotated about shaft 90. Such motion of rod 91 drives a pivoting motion of cam-like lever 76 about the vertical axis of vertical section 81, and arm 63 is likewise pivoted about the vertical axis of vertical section 81. The force of motor 86 which is responsible for this pivoting of arm 63 is transferred by the force of crank arm 89 against detent 92 of rod 91. The limits of this pivoting of arm 63 are determined by the characteristics of motor 86.

Similarly, upon actuation of solenoid 125, test rod 122 pivots cam-like lever 76 about the vertical axis of vertical section 81. Solenoid 125 has limits during actuation of solenoid 125 which restrict the movement of shaft 124. These limits of solenoid 125 are incorporated in a manner which limits the pivoting of rinsing nozzle 75. These pivotal limits of rinsing nozzle 75 by solenoid 125 allow rinsing nozzle 75 to pivot from the position shown in FIG. 1 to a position substantially below the lip 129 of contoured panel 125 to a test position 312 (shown in FIG. 3). Test position 312 is a position such that only a portion of a spray through orifice 82 would be sprayed upward beyond lip 129 while other portions of spray 82 are deflected by lip 129 into recess 297 (shown in FIG. 3).

Note that upon actuation of solenoid 125, rod 91 will also translate away from spring connection 128; however, since rod 91 is slideably engaged through pin 88, the actuation of solenoid 125 is not accompanied by movement of pin 88, but rather rod 91 slides in relation to pin 88. On the other hand, the rotating operation of motor 86 does cause the movement of shaft 124 with respect to coils 126. Also note that in an alternative embodiment (not shown) orifice 82 and port 57 are replaced by rotating nozzles for improving the spray onto the crotch area of the user of the alternative embodiment. Such rotating nozzles are rotated with respect to arm 63 about nozzles 75 and 76 respectively. The rotating of such rotating nozzles is driven by the hydraulic force of the fluids flowing from nozzles 75 and 56, respectively.

Referring again to the preferred embodiment of the present invention, a user of the apparatus of the present invention ideally positions the body of the user on seat 20 in an ordinary position. When the user is seated thus, pubic seal 22 may be manually positioned in a position furthest from front planar member 12. Accordingly, a substantial seal is formed around the crotch area of the body of the individual for containing fluids that accompany the operation of the apparatus of the present invention within excretion receiving chamber 109. This seal is effected as the shape of pubic seal 22 enables pubic seal 22 to form a seal with the legs and upper pubic area of the user so that the crotch area of the user is contained in a space communicating with excretion receiving chamber 109. Cleavage seal 21, furthermore, similarly seals fluids within a space communicating with excretion receiving chamber 109 by forming a seal with the buttocks cleavage of the user above the crotch area of the user's body.

A heated air supply system in the preferred embodiment of the present invention includes compressor 40, air supply line 131, blower nozzle 132, and sealed space 27. These components 40, 131, 27, and 132 comprise a system which supplies compressed air from compressor 40 through blower port 45 of blower nozzle 132. Blower port 45 is in sealed communication with compressor 40 for enabling pressurized air to exit the system through blower port 45. Furthermore, air supply line 131 includes heating element 130 for heating the air which flows through air supply line 131. Heating element 130 is a standard air heating element similar to those incorporated for heating air in blow dryers that are used for drying hair. Heating element 130 is integrally formed with air supply line 131 along the course of air supply line 131. A first end of air supply line 131 is connected to compressor 40 at compressor outlet 133 (shown in hidden lines), and air supply line 131 is connected at a second end of line 131 to contoured panel 25 at port 28 for enabling communication between port 28 and the air compressed by compressor 40. As space 27 is a sealed space between contoured panel 25 and top planar member 13, compressed air supplied through port 28 is communicated to port 29 as well as blower port 45. Blower nozzle 132 is pivotally and sealingly connected to contoured panel 25 at port 29 for enabling the communication between port 29 and blower port 45. Blower nozzle 132 encloses an air conduit in sealed communication with port 29. The shape of blower nozzle 132 enables the blowing of the compressed, heated air through blower port 45 in an approximately upward direction.

Referring now to FIG. 3, lever 96 is rigidly connected to blower nozzle 132. Rod 94 is pivotally connected to lever 96 with pin 117. One end of extension spring 116 is also rigidly connected to lever 96 near pin 117; and a second end of extension spring 116 is rigidly connected to contoured panel 25 at spring connection 118. Blower nozzle 132 pivots with respect to contoured panel about a vertical axis through the center of port 29.

Accordingly, the operation of motor 87 cause pivoting of blower port 45 beneath access 17 about the vertical axis through the center of port 29. Motor 87 is mounted to top planar member 13. Similar to the aforementioned operation of motor 86 with respect to rod 92, the operation of motor 87 conveys a pivoting force to detent 95 of rod 94, which pivoting force causes translation of rod 94 approximately toward and away from spring connection 118 in a direction approximately colinear with the length of rod 94. Spring 116 biases lever 96 toward spring connection 118, but the operation of motor 87 transfers an oscillating force through rod 94 to lever 96, which oscillating force opposes and favors, in an oscillating manner, the spring bias of spring 116. Accordingly, during operation of motor 87, lever 96 oscillates approximately away from and toward spring connection 118, and blower port 45 accordingly pivots beneath access 17.

This pivoting of blower port 45 beneath access 17 has pivoting limits which are determined by various interrelated characteristics of motor 87, rod 94, lever 96 and blower nozzle 132. These limits of the pivoting of blower port 45 are represented by the inoperative position 300 of blower port 45, and a second position 301 (shown in hidden line). A blower detent means (not shown, but represented schematically as component 600 in FIG. 4) is also included for stopping lower port 45 from returning to the inoperative position 300 while motor 87 is operating. This blower detent means effectively causes blower port 45 to pivot between the second position 301 and an operating limit position 302 (shown in hidden lines) during operation of motor 87. This blower detent means comprises a small solenoid mounted to contoured panel 25 in recess 295 between rim 103 and contoured panel 25. When the solenoid of the blower detent means is actuated, the pivoting of blower port 45 is effectively limited at operating limit 302 by the solenoid of the blower detent means stopping lever 96 from returning to the position (shown in FIG. 3) that is closest spring connection 118. Note that although the motion of lever 96 is, thus, limited by the solenoid of the blower detent means, and the translating motion of rod 94 is accordingly limited as well, the operation of motor 87 is not affected since rod 94 is slideably engaged through the pin of motor 87. During the operation of the apparatus of the present invention, when the solenoid of the blower detent means is deactuated, the pivoting of blower port 45 includes pivoting blower port 45 to the inoperative position 300. The solenoid of the blower detent means is actuated whenever the user of the apparatus of the present invention causes the transmission of an electrical signal to operate motor 87; however, virtually identically to aforementioned motor 86, motor 87 includes means for returning the rotating arm of motor 87 to the position shown in FIG. 3 when motor 87 is not otherwise caused to operate. Thus, when the electrical signal caused by the user for operating motor 87 is ceased, the solenoid of the blower detent means is deactivated and blower port 45 is enabled to return to the inoperative position 300 as the rotating arm of motor 87 returns to the position shown in FIG. 3.

Similarly, during the rotating operation of motor 86 (shown in FIG. 1), nozzles 56 and 75 are pivoted about the vertical axis of vertical section 81 (shown in FIG. 1) within the excretion receiving chamber 109 beneath access 17 and contoured panel 25. This pivoting of nozzles 56 and 75 is between a first position 310 and a second position 311 (shown in hidden lines). When motor 86 is not operating and solenoid 125 is not actuated, nozzles 56 and 75 remain in the first position 310 beneath recess 297 of contoured panel 25. When motor 86 is not operating and solenoid 125 is actuated, nozzles 56 and 75 are in a test position 312 (shown in hidden lines). When motor 86 is operating and solenoid 125 is not actuated, nozzles 56 and 75 pivot between the first position 310 and the second position 311. When motor 86 is operational and solenoid 125 is also actuated, nozzles 56 and 75 pivot between the test position 312 and the second position 311.

As previously indicated, contoured panel 25 includes recesses 295 and 297 and has a sealed break 296. Recesses 295 and 297 are formed integrally with contoured panel 25. Recess 295 is for enabling the motion of rod 94 between rim 103 and contoured panel 25 and is also for containing the electrically effected detent means (not shown) between rim 103 and contoured panel 25. Recess 297 is for reflecting spray from nozzles 56 and 75 in a manner that reflects such spray toward the excretion receiving chamber 109 of toilet 100. The break 296 in contoured panel 25 is for enabling the pivoting movement of armature 63 and coaxial line 55. Although recesses 295 and 297 protrude slightly into the space 27 (shown in FIG. 1) that is enclosed by contoured panel 25, recesses 295 and 297 do not substantially impair the essential flow of heated air within space 27. Break 296 is a discontinuity in contoured panel 25, and space 27 does not span break 296, but rather space 27 is sealed by the edges of contoured panel 25 being sealingly connected to top planar member 13, which edges of contoured panel 25 are immediately adjacent break 296. In an alternative embodiment (not shown), break 296 is a recess, shaped similar to break 296 rather than a sealed break in order to enhance the flow of heated air within space 27 (shown in FIG. 1).

Referring briefly to FIG. 2, means including looped cable 281 is incorporated in the apparatus of the present invention to operate the flush handle 110 for effecting the flushing of excretion receiving chamber 109. As also shown in FIG. 1, this flushing means further comprises solenoid 280, sleeve-like rod 282 and stop 283. Solenoid 280 is mounted on right planar member 14. The lower end 278 of looped cable 281 is rigidly connected to the shaft 284 of solenoid 280. Upon electrical actuation of solenoid 280, the shaft 284 of solenoid 280 is translated downward from the position shown in FIG. 1, towards floor 112. Sleeve-like rod 282 is rigidly connected to the top planar member 13 in a substantially vertical position. Looped cable 281 has a loop 279 at the upper end 279 of looped cable 281. Looped cable 281 communicates through sleeve-like rod 282 and looped cable 281 is able to translate in vertical directions within sleeve-like rod 282. Stop 283 is rigidly connected near the upper end of looped cable 281. Stop 283 limits the downward motion of looped cable 281 since stop 283 cannot pass beneath the upper end 284 of sleeve-like rod 282. Loop 279 is connectable to the flush handle 110 (shown in FIG. 2) of a standard toilet 100. In the operation of the flush operating means, solenoid 280 is actuated, looped cable 281 is translated downwardly by solenoid 280 as limited by stop 283, and flush handle 110 is accordingly actuated for flushing the excretion receiving tank 109.

Each of the electro-mechanical devices—including compressor 40, solenoids 125 and 280, motors 86 and 87, and the solenoid of the blower detent means (not shown), as well as valves 50, 64 and 69—are electrically operated and are controlled in their operation by control box 150. Heating element 130 is also electrically operated and controlled by control box 150. Control box 150 has buttons 151 through 158, which buttons control electrical switches (shown schematically in FIG. 4) that are enclosed by control box 150. Buttons 151 through 158 are standard buttons for controlling such switches.

Each of buttons 151 through 158 are spring biased in a disengaged, upward position, which upward positions are those positions shown in FIG. 1. When each of buttons 151 through 158 are depressed in their position with respect to box 150, each of buttons 151 through 158, respectively, close specific electrical switches as will be discussed further in detail. Button 155 has an overhanging portion 159 extending over button 156. Overhanging portion 159 is rigidly mounted to the top of button 155. Overhanging portion 159 is positioned for simultaneously depressing button 156 when button 155 is depressed.

Detaining means (not shown) is also included within control box 150 for detaining each of buttons 152 through 158 in their depressed position after the respective button 152 through 158 has been depressed. In contrast button 151 returns to its upwardly biased position after being depressed. The aforementioned detaining means within control box 150 also includes means for releasing buttons 152 through 158 from their detained positions when another of buttons 152 through 158 is depressed. Thus, when any of buttons 152 through 158 is depressed, it subsequently remains in the respective depressed position until it is released as another of buttons 152 through 158 is depressed. Since the depression of button 155 is simultaneously accompanied by the depression of button 156, neither of buttons 155 and 156 are detained by the detaining means when button 155 is depressed but button 156 is detained if depressed separately from button 155. This detaining means within control box 150 is of the type commonly available with electrical control buttons. The detaining means is mounted to control box 150 on the inside of control box 150, and the detaining means is connected to each of buttons 152 through 158 in a manner that fully enables the operation of the detaining means as described in relation to buttons 152 through 158.

Figure 4:
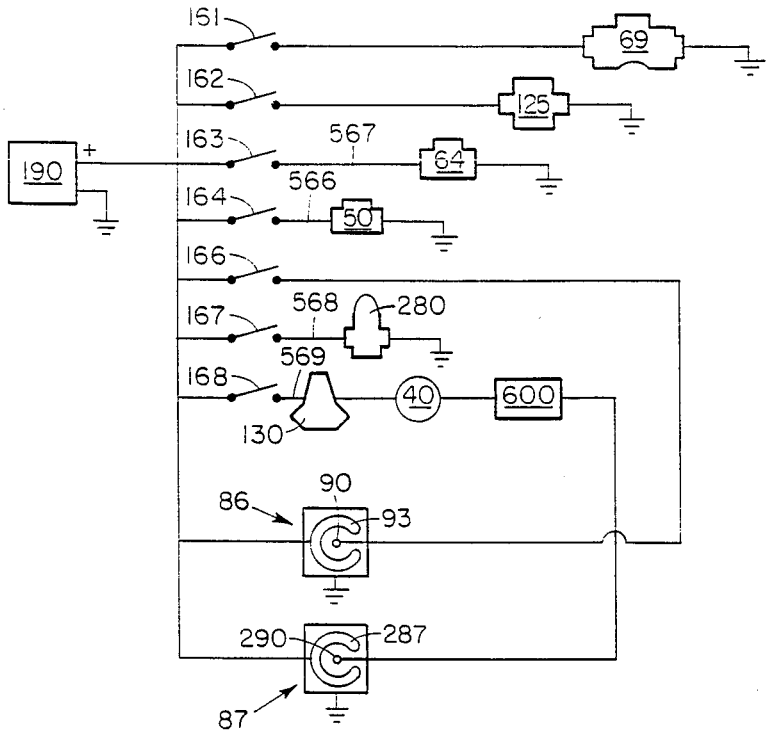
FIG. 4 is a schematic diagram of the electrical circuitry of the present invention.

Referring now to FIG. 4, the electric circuitry of the present invention is shown schematically. Note that each of the lines, such as line 149, represent electrically conductive wiring for enabling direct electrical communication between the designated electrical components 69, 125, 64, 50, 86, 280, 40, 130, 87, the solenoid of the blower detent means, and switches 161 through 168, as well as the AC power supply 190. Note also that components 69, 125, 64, 50, 86, 280, 40, 130, 87 and the solenoid of the blower detent means are operated and actuated, appropriately, by enabling electrical communication of the alternating current of the AC power supply 190 through the respective electrical component; and the appropriate operation and actuation of an individual electrical component 69, 125, 64, 50, 86, 280, 40, 130, 87 and the solenoid of the blower detent means is disabled when the electrical communication of the alternating current of the AC power supply 190 through the respective electrical component 69, 125, 64, 50, 86, 280, 40, 130, 87 and the solenoid of the blower detent means is disabled.

Accordingly, the closing of switch 161 enables the actuation of mixing valve 69. The closing of switch 162 enables the actuation of test solenoid 125. The closing of switch 163 enables the actuation of rinsing valve 64. The closing of switch 164 enables the actuation of cleansing valve 50. The closing of switch 166 enables the operation of motor 86. The closing of switch 167 enables the actuation of solenoid 280. The closing of switch 168 enables the operation of air compressor 40, the heating by heating element 130, the operation of motor 87 and the actuation of the solenoid of the blower detent means. Air compressor 40, heating element 130, motor 87, and the solenoid of the blower detent means are electrically connected in series.

AC power supply 190 is a standard 110 volt AC power supply and may be, as in an alternative embodiment (not shown), substituted by a DC power supply with other appropriate changes in the circuitry of the apparatus of the present invention. Each of the electrical grounds (standardly designated in FIG. 4) of the electrical circuitry are common electrical grounds and are, thus, in direct electrical communication with each other of the electrical grounds of the electrical circuitry.

The electrical contacts 93 and 287 of motors 86 and 87, respectively, are connected in direct electrical communication with the positive terminal of AC power supply 190; however, operation of motors 86 and 87 is initiated only by enabling electrical communication of the alternating current of the AC power supply 190 through shafts 90 and 290, respectively. Referring again to the operation of motors 86 and 87, when the rotatable arms of motors 86 and 87 respectively are in certain positions, electrical communication is enabled between the contacts (93 and 287) and the shafts (90 and 290) through the rotatable arms of the motors 86 and 87, respectively.

Figure 10:
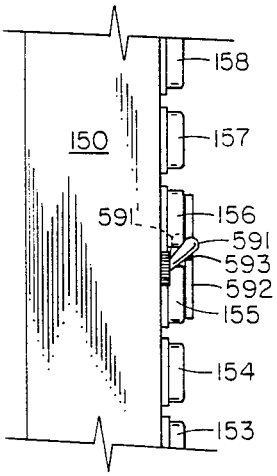
FIG. 10 is a right side elevation view of part of the control box shown in FIG. 9.
Figure 9:
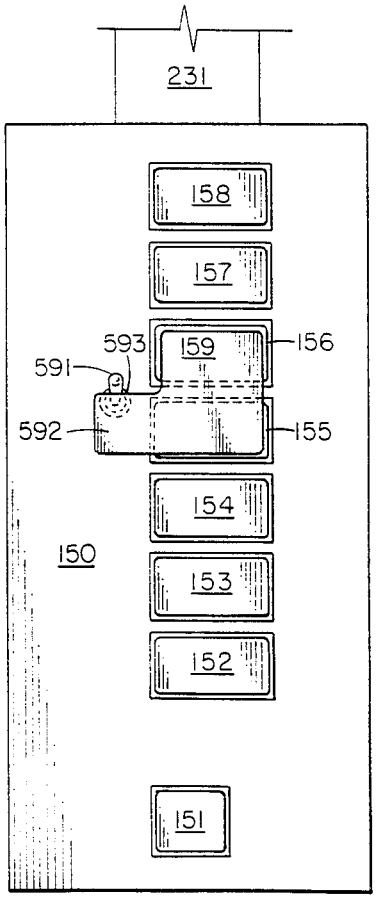
FIG. 9 is a top view of the control box of the apparatus of the present invention oriented with the rearward direction being toward the top of FIG. 9.

Referring briefly to FIGS. 9 and 10, control box 150 is shown, enabling particular clarity with regard to buttons 155 and 156 and lever 591. Lever 591 is similar to a toggle switch, being pivotally connected to control box 150 and positionable in two positions—an actuated position, which is the position shown in FIG. 10, and a deactuated position 591' (shown in broken line in FIG. 10). The actuated and deactuated positions correspond to the closing and opening, respectively, of switch 161 and lever 191 is interconnected with switch 161 in a manner that enables such function.

In addition to overhanging portion 159, button 155 also has overhanging extension 592 which is similar to overhanging portion 159, but extends over the pivotal connection of lever 591 rather than button 156. Note that both overhanging portion 159 and extension 592 are rigidly bonded to button 155. Overhanging extension 592 is such that lever 591 bears against the rearward edge 593 of overhanging extension 592 when 591 is in its actuated position. When button 155 is depressed toward control box 150, the rearward edge 593 forces lever 591 to move to its deactuated position 591. Lever 591 is manually moved to its actuated position by a person utilizing the apparatus of the present invention.

The switches 162 through 168 are closed by certain ones of buttons 151 through 158. The depression of button 151 closes switch 162. The depression of button 152 closes switch 163 and releases any others of buttons 152 through 158 that are detained by the detaining means within control box 150. The depression of button 153 closes switches 164 and 166 and releases any others of buttons 152 through 158 that are detained by the detaining means within control box 150. The depression of button 154 closes switches 163 and 166 and releases any others of buttons 152 through 158 that are detained by the detaining means within control box 150. The depression of button 155 causes the simultaneous depression of button 156 and the movement of lever 591 to its deactuated position 591. The depression of button 156, more particularly, closes switch 167. Recall that the simultaneous depression of buttons 155 and 156 release one another and also releases any others of buttons 152 and 158 that are detained by the detaining means within control box 150. The depression of button 157 closes switch 168 and releases any others of buttons 152 through 158 that are detained by the detaining means within control box 150. The depression of button 158 merely releases any others of buttons 152 through 158 that are detained by the detaining means within control box 150. Upon release of a button 151 through 158 that closes certain respective switches 161 through 168 as outlined above, the certain respective switches 161 through 168 are simultaneously opened unless otherwise closed by others of buttons 151 through 158. Note that the discussion of the functions of the depression of these buttons 151 through 158 in this paragraph does not limit the previously and subsequently described functions of buttons 151 through 158.

Referring again to FIG. 1, the electrical circuitry schematically represented in FIG. 4 thus enables communication between buttons 151 through 158 and their appropriate electrical components 69, 125, 64, 50, 86, 280, 40, 130, 87 and the solenoid of the blower detent means; this communication between the buttons and the electrical components is further enabled by electrically conductive wiring (schematically represented as lines in FIG. 4) positioned through support 230, which support 230 functions in part as a conduit 230. Support conduit 230 is rigidly connected to control box 150 in a manner that enables communication between the communicating space of support conduit 230 and the space enclosed by control box 150. Control box 150 is positioned with respect to an ordinarily positioned body seated upon seat 20 so that the ordinarily positioned body can easily operate the buttons of control box 150. The lateral section 231 of support conduit 230 is a grippable section that is grippable by the hand of a human for enabling the support of the human, particularly for enabling support while the human is utilizing the apparatus of the present invention. The horizontal positioning of the lateral section 231 also enables the human supporting aspect of lateral section 231, and lateral section 231 is appropriately positioned horizontally. The base (not shown) of support conduit 230 is rigidly connected to right planar member 14 in a manner that enables communication between the communicating passage of support conduit 230 and the space enclosed by housing 10. Support conduit 230 has a cylindrical shape.

In operation, the user of the apparatus of the present invention controls the apparatus by manually actuating lever 591 and depressing buttons 151 through 158 in a sequence. A particular sequence is ideal. The ideal particular sequence, in brief, is the sequential depressing of buttons 152, 151, and 153 through 158. The particular ideal sequence is further discussed in this description.

According to the particular ideal sequence, after or while utilizing the toilet 100 for excretory purposes, lever 591 is manually moved to its actuated position and valve 69 is accordingly actuated for mixing cold and hot water from lines 71 and 72, respectively, to produce warm water source 62. Subsequently button 152 is depressed and valve 64 is accordingly actuated for spraying warm water through orifice 82 upward into recess 297. Since the water in hot water line 72 is often initially cool, warm water source 62 will become warmer, approaching a steady-state temperature as time progresses. Accordingly, the temperature of the water sprayed upwardly through orifice 82 will approach a steady state in time.

By depressing button 151, the operator tests the temperature of the water spraying from rinsing nozzle 75 through orifice 82 as portions of this spray through orifice 82 are directed upwardly past lip 129 and onto a small part of the body of the user for enabling determination of the temperature of the water spraying through orifice 82 by the user. The temperature of the water spraying through orifice 82 approximately equals the temperature of warm water source 62, likewise, approximately equals the temperature of the water flowing through coaxial line 55. When the temperature of the water spraying through orifice 82 has reached a temperature suitable to the user, which temperature is ideally a steady-state warm temperature of the water, the user depresses button 153. Obviously, if the user does not desire to test the temperature of the water spraying through orifice 82, the depressing of buttons 151 is omitted from the sequence. When button 153 is depressed, the soap-water mixture (being mixed in nozzle 56 from water having the suitable temperature and from soap drawn from the inner line of coaxial line 55, the temperature of which soap has approached the suitable temperature of the water also flowing through coaxial line 55) is sprayed from nozzle 56 through port 57 onto the crotch area of the body of the user as arm 63 pivots within excretion receiving chamber 109 and nozzle 57 pivots beneath the crotch area of the body of the user. Thus, cleansing fluid (the soap-water mixture) is sprayed onto the crotch area from a nozzle moving directly beneath those crotch area.

After adequate cleansing fluid has been sprayed on the crotch area of the body of the user, the user depresses button 154, and the soap-water spray is ceased while the rinsing fluid is sprayed onto the crotch area of the body of the user through orifice 82 of rinsing nozzle 75. When adequate rinsing of the crotch area of the body of the user has been accomplished by the rinsing fluid being sprayed through orifice 82 as arm 63 pivots beneath the crotch area of the body of the user, button 155 is depressed by the user. The depression of button 155 causes the actuation of solenoid 280 and simultaneously depresses button 156. Solenoid 280, accordingly, causes the flushing of excretion receiving chamber 109. The simultaneous depression of button 156 causes the spray of fluid through orifice 82, and nozzles 56 and 75 are returned by motor 86 to beneath recess 297 and the spray of fluid through orifice 82 is ceased.

Next, the user depresses button 157 and the drying operation of the apparatus of the present invention begins. Air is accordingly compressed by compressor 40, heated by heating element 130 and blown upwardly across the crotch area of the body of the user through blower port 45 as blower nozzle 132 pivots beneath the the user. Once blower port 45 has pivoted from the inoperative position 300 of blower port 45 past the operating limit 302, blower port 45 pivots about vertical axis through port 29 and between second position 301 and operating limit 302 until button 158 is depressed. When button 158 is depressed, the blower detent means is deactuated, and motor 87 returns blower port 45 to the inoperative position 300; spring 116 also enables the return of blower port 45 to the inoperative position 300. Once the drying operation has thus been completed, crotch area of the body of the user has been cleansed, rinsed and dried.

Figure 7:
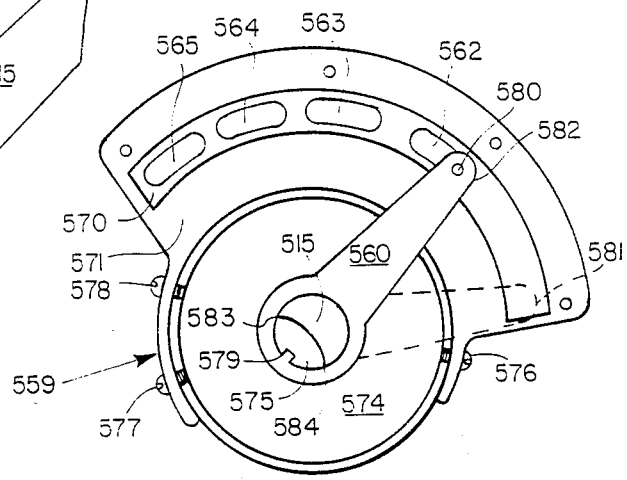
FIG. 7 shows a right side elevation view of the rotating electrical connection of the apparatus of an alternative embodiment of the present invention.
Figure 5:
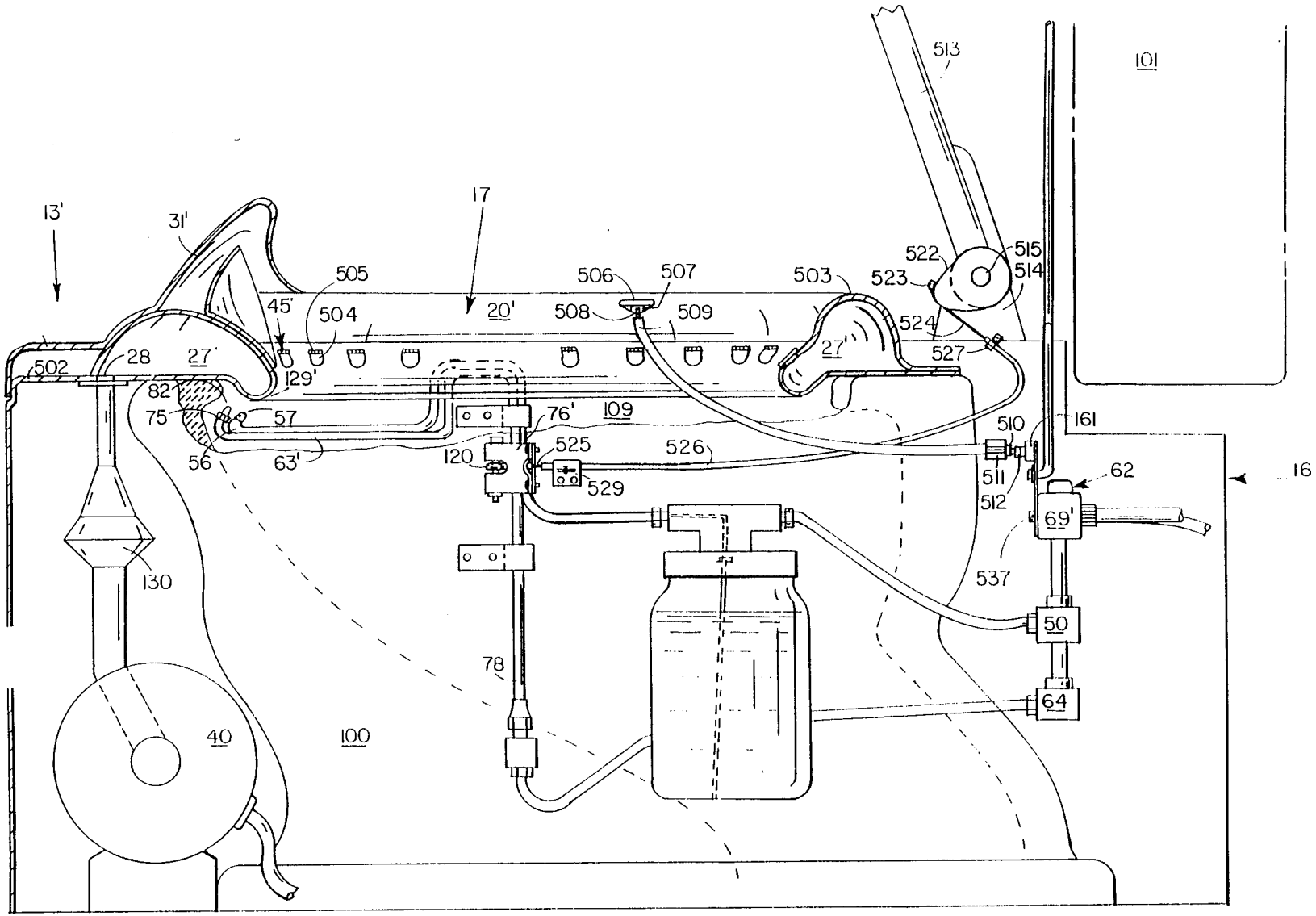
FIG. 5 is a cut-away left side elevation view of the apparatus of an alternative embodiment of the present invention.
Figure 6:
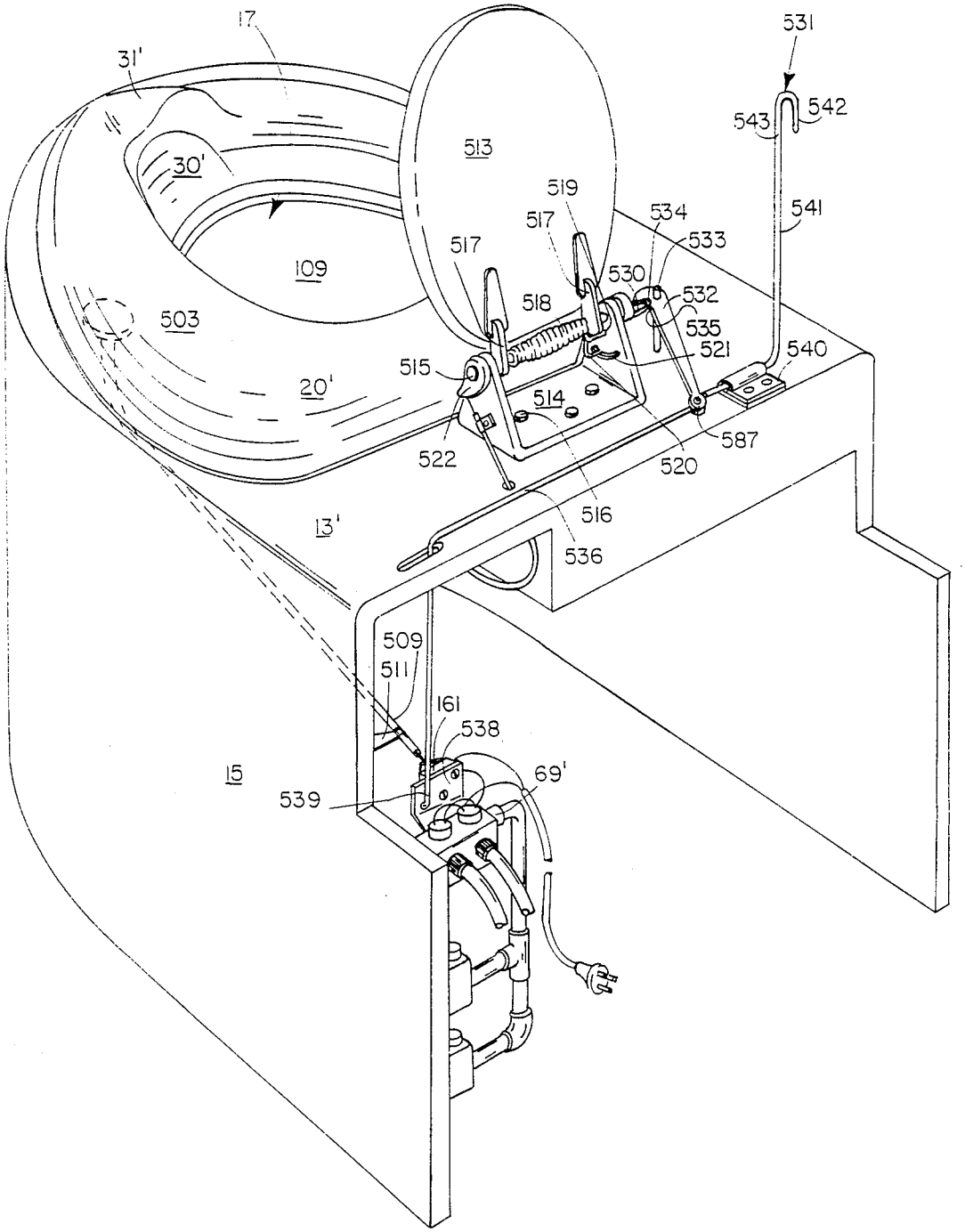
FIG. 6 is a birds-eye perspective view from the rear side of the apparatus of an alternative embodiment of the present invention.

Another alternative embodiment of the present invention is shown in FIGS. 5 and 6. The main purpose of this alternative embodiment is to provide an apparatus which performs substantially the same functions as the preferred embodiment of the present invention, but which alternative embodiment is controllable in its operation by movement of the back of an ordinarily positioned user seated on seat 20' rather than controllable by operating control box 150 (shown in FIG. 1). Many aspects and components of the alternative embodiments shown in FIGS. 5, 6 and 7 are identical in structure and function to aspects of the preferred embodiment of the present invention, and these particular aspects and components are, accordingly, numbered in FIGS. 5, 6 and 7 with numbers that correspond to the numbers in FIGS. 1 through 4. Other aspects and components of the alternative embodiments of the present invention are similar in structure and function but have slight variations; such slightly varied aspects and components are indicated in FIGS. 5, 6 and 7 with reference numerals that are the same as those in referencing the similar aspects and components in FIGS. 1 through 4, however, they are indicated with a prime notation following the numerals in FIGS. 5, 6 and 7. For example, seat 20' (shown in FIGS. 5 and 6) is substantially similar in structure and function to seat 20 (shown in FIGS. 1 and 2) but seat 20' comprises variations to seat 20. While these similarities between the preferred embodiment and the alternative embodiments have been previously described in this description, the following description of the alternative embodiments of the present invention concentrates on the material differences between the alternative embodiments and the preferred embodiment.

Referring again to the alternative embodiment shown in FIGS. 5 and 6, since a pubic seal connected to rise 31' is not included, nozzles 56 and 75 are positioned to spray liquid through port 57 and orifice 82 in an upward direction slightly canted from the vertical for avoiding the spray of fluids through port 57 and orifice 82 upwardly past the pubic area of a user seated in an ordinary position on seat 20'. Additionally, upper planar member 13' comprises a composite member formed by sections 501 and 502.

Enclosed space 27' which communicates with port 28 also communicates with a plurality of blower ports 45'. Heat (provided by heating element 130) from the air contained within space 27' communicates directly with the upper surface 503 of seat 20', and the upper surface 503 is composed of a thermally conductive, semi-rigid material for transferring heat from the air within space 27' to the body of a user positioned in an ordinary position on seat 20'. Blower ports 45' are each provided with flaps 504 hinged at hinges 505 to seat 20'. Flaps 504 are positionable in opened and closed positions (closed position shown in FIG. 5) for enabling and disabling, respectively, fluid communication from space 27' to a space beneath the body of the user positioned on seat 20' in an ordinary position, which space fluidly communicates with excretion receiving chamber 109. Flaps 504 are biased by the force of gravity in the closed position; however, air pressure within space 27' generated by compressor 40 opposes the gravitational bias on flaps 504 and, thus, forces flaps 504 into opened positions when compressor 40 is operated. Flaps 504, thus, function as one-way valves preventing the flowing of fluids into space 27' through blower ports 45'. A seal preventing the escape of fluids from the space beneath the body of an ordinarily positioned user on seat 20', which space communicates with excretion receiving chamber 109, is thus enabled by flaps 504.

Weight sensitive control 506 is positioned within space 27' adjacent upper surface 503. Weight sensitive control 506 comprises pad 507 rigidly connected to flexible cable 508 which is slideably engaged through flexible tubing 509. Flexible tubing 509 is rigidly connected to seat 20' at a weight sensor port (not shown). Flexible tubing 509 has a fixed operative end 510, which fixed operative end is rigidly connected to left planar member 15 by rigid bracket 511. Flexible cable 508 is slideably engaged through flexible tubing 509 to the actuating part of switch 161', which actuating part is actuable to close switch 161' as switch 161' is an electrical switch for completing an electrical circuit. Switch 161', when actuated, completes the electrical circuit for actuating mixing valve 69' for enabling the production of warm water source 62. Flexible cable 508 has a switch actuating end 512 that abuts the actuating part of switch 161'. When pad 507 is forced downwardly by the weight of a user on the upper surface 503 of seat 20', flexible cable 508 accordingly moves toward switch 161' through the actuating end 510 of flexible tubing 509 to actuate switch 161'. The semi-rigid nature of the material of the upper surface 503 of seat 20' enables the downward movement of pad 507 when the upper surface 503 supports the weight of a user seated on seat 20'.

The pivoting of nozzles 56 and 75 beneath access 17 is operated by the back of a user seated on seat 20' in an ordinary position as enabled by a pivotal linkage system between lid 513 and cam-like lever 76'. Lid 513 is pivotally connected to support 514 by shaft 515 through journals (not shown) in support 14. Support 514 is rigidly connected to upper planar member 13' with a plurality of bolts 516. Shaft 515 is rigidly connected to lid 513 at the appendages 516 and 517 of lid 513. Shaft 515 is substantially horizontal and is positioned with the longitudinal ends of shaft 515 running laterally left and right.

Lid 513, although appearing as a lid of a common toilet, is restricted by torsional spring 518 from moving to a position which closes access 17. Torsional spring 518 encircles shaft 515 and has fixed end 519 and an opposing end 520. Fixed end 519 is rigidly connected to appendage 517. Opposing end 520 is slideably engaged through arced slot 521 in support 514, which arced slot 521 is an arc about the journal in support 514 through which shaft 515 pivots. Torsional spring 518 effects a torsional force about shaft 515 between fixed end 519 and opposing end 521, which torsional force opposes the rearward (i.e. toward holding tank 101) pivoting of lid 513 beyond an approximately upright position of lid 513, which positions lid 513 slightly forward of an exactly vertical position. Torsional force of torsional spring 518 additionally opposes the forward pivoting of lid 513 beyond a half-closed position. In the half-closed position, lid 513 is positioned at approximately 60 degrees from the horizontal for avoiding the necessity of opening the lid 513 from access 17 when a user is attempting to position the user's body in an ordinary position on seat 20'.

Cam-shaped lever 522 is rigidly connected to shaft 515. A first end of flexible cable 524 is rigidly connected to cam-shaped lever 522 at connection 523. The second end 525 of flexible cable 524 is rigidly connected to eyelet 120 for transferring pivoting force from flexible cable 524 to cam-like lever 76', which pivoting force enables the pivoting of cam-like lever 76' about the vertical axis of rigid line 78. Flexible cable 524 is slideably engaged through flexible tubing 526. A first end of flexible tubing 526 is fixed to support 514 by bracket 527. A second end of flexible tubing 526 is fixed to left planar member 15 by bracket 529. Thus, the rearward pivoting of lid 513 about shaft 515 translates into the sliding of flexible cable 524 through flexible tubing 526 toward cable connection 523; eyelet 120 accordingly moves toward bracket 529 and the pivoting of cam-like lever 76' is effected; and nozzles 56 and 75 pivot beneath access 17 for positioning nozzles 56 and 75 beneath the user's crotch area. The angular range of positions through which lid 513 necessarily pivots for pivoting nozzles 56 and 75 between their first position 310 (shown in FIG. 3) and their second position 311 is the nozzle pivoting range. By pivoting lid 513 through the nozzle pivoting range in this manner, with torsional spring 518 returning lid 513 to the upright position, a user of this alternative embodiment can, thus, manually pivot nozzles 56 and 75 beneath the user's crotch area without utilizing electronic means for pivoting nozzles 56 and 75.

Cam-like post 530 is also rigidly connected to shaft 515 for rotating post 530 about the axis of shaft 515. This rotating of post 530 about the axis of shaft 515 controls the deactuation of valve 69' and the actuation of the flush handle 110 (shown in FIG. 2) with flush actuator 531. L-shaped lever 532 pivots about vertical shaft 533. Vertical shaft 533 is rigidly connected to upper planar member 13' and is positioned in a substantially vertical position. Lever 532 is shown in its unactuated position in FIG. 6. After a user ordinarily positions the user's body on seat 20', lever 532 remains in the unactuated position of lever 532 until lid 513 is pivoted rearwardly about shaft 515 beyond the nozzle pivoting range, post 530 engages the actuating portion 534 of lever 532 and pivoting of lid 513 further rearward beyond this engaging position causes the pivoting of lever 532 about pin 533 by post 530. When post 530 pivots lever 532 about shaft 533, lever 532 is pivoted to an actuated position (not shown) of lever 532. When the user removes himself from seat 20', lid 513 pivots forwardly to its forward-most position at approximately 60 degrees from the horizontal. This pivoting to the forward-most position of lid 513 is imparted by torsional spring 518 as well as the force of gravity on lid 513. When lid 513 pivots to this forward-most position, post 530 engages the deactuating surface 535 of lever 532 and pivots lever 532 to the unactuated position of lever 532.

When lever 532 is in the actuated position of lever 532, L-shaped rod 536 is caused to deactuate valve 69' by causing the pivoting of switch 161' about pivotal connection 537. A first end 587 of L-shaped rod 536 is pivotally connected about a vertical axis at the actuating end of lever 532, and a second end 539 of L-shaped rod 536 is pivotally connected to plate 538 about a laterally disposed horizontal axis. Switch 161' is operably mounted on plate 538. Plate 538 is pivotally connected to valve 69' at pivotal connection 537, pivoting about a forwardly and rearwardly running horizontal axis. When plate 538 pivots toward left planar member 15 about pivotal connection 537 in correspondence with the actuation of lever 532, the actuating end 512 (shown in FIG. 5) of flexible cable 508 within flexible tubing 509 moves with respect to the actuating part of switch 161' to a position (not shown) which allows the opening of switch 161' despite the operation of weight sensor 506. Recall that switch 161' is biased in the open position of switch 161'. The pivoting of lever 532 into the actuating position of lever 532 thus moves L-shaped rod 536 away from bracket 540 and causes the pivoting of plate 538 to a position which allows the opening of switch 161' and the corresponding deactuation of valve 69'.

Simultaneously, when lever 532 is pivoted to its actuating position, flush actuator 531 is also actuated. Flush actuator 531 comprises a rigid tubing 541 having an L-shape positioned with one leg of the L-shape in a substantially vertical position, and a hook-shaped rigid tubing member 542 having a telescopically engaged portion telescopically engaged with the vertical leg of L-shaped tubing 541 for enabling movement of hook shaped member 542 in vertical directions. A flexible cable (not shown) is rigidly connected to the inside of hook-shaped member 542, and this flexible cable is disposed through rigid tubing 541 to the actuating end 587 of lever 532. This flexible cable rigidly connected within hooked tubing 542 is also rigidly connected to lever 532 at actuating end 587 of lever 532. Thus, when lever 532 is pivoted to the actuating position of lever 532, the flexible cable connected to the actuating end 587 is pulled through rigid tubing 541 to effect the downward movement of hook-shaped member 542. This downward movement of hook-shaped member 542, when hook-shaped member 542 is engaged with the flush handle 110 (shown in FIG. 2), actuates the flushing of excretion receiving chamber 109.

The operation of this alternative embodiment of the present invention (shown in FIGS. 5 and 6) is as follows: Upon the positioning of the body of the user on seat 20', weight sensitive control 506 (shown in FIG. 5) causes the mixing of warm water source 62 within mixing valve 69'; when the user desires cleansing of the user's crotch area, the user pivots nozzles 56 and 57 beneath the user's crotch area by pivoting the user's back; (assuming valves 50 and 64 being omitted or otherwise opened by means not shown in FIGS. 5 and 6) fluids are sprayed through port 57 and orifice 82 of nozzles 56 and 75, respectively, onto the user's crotch area; lever 532 is actuated by the user pivoting the user's back further rearward than the nozzle pivoting range; lever 532 is pivoted to the actuating position of lever 532, causing the actuation of flush actuator 531 and simultaneously causes the opening of switch 161'; the flow of fluids through ports 57 and 82 are, thus, ceased; the excretion receiving chamber 109 is accordingly flushed; when desired, the user removes his body from the ordinary position on seat 20'; and lever 532 is returned to its ready, deactuated position by the pivoting of lid 513 to the half-closed position.

Note also that additional electronic or manual means may be incorporated with this alternative embodiment of the present invention (shown in FIGS. 5 and 6) in order to further enable operations similar to the operation of the preferred embodiment of the present invention (shown in FIGS. 1 through 4).

Figure 8:
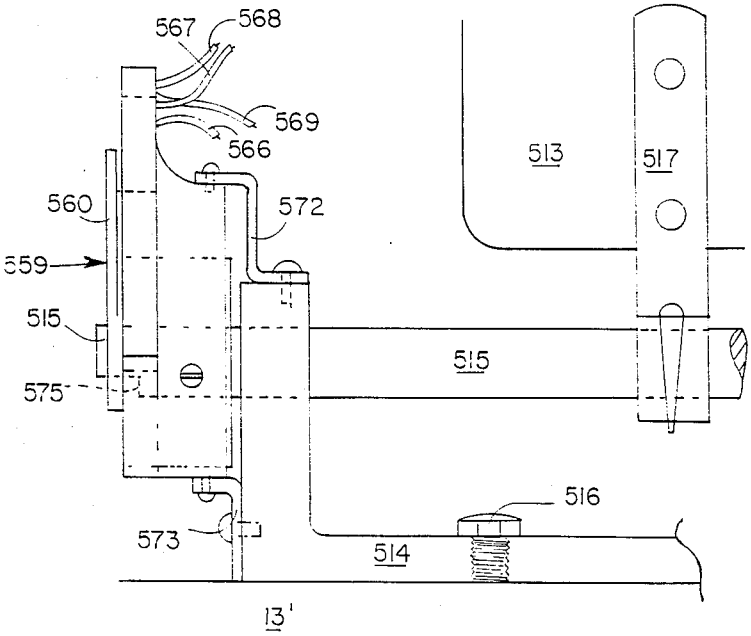
FIG. 8 is a close up, front elevation view showing the rotating electrical connection of FIG. 7 in relation to other components of the apparatus of an alternative embodiment of the present invention.

Accordingly, another alternative embodiment of the present invention, referring additionally to FIGS. 7 and 8, utilizes a rotating electrical connection 559 which is actuable by the back of the user to complete electric circuits for operating such components as valves 50 and 64, solenoid 280, compressor 40 and heating element 130 of the alternative embodiment of the present invention shown in FIGS. 5 and 6. The rotating connection 559 replaces lever 532 of the alternative embodiment shown in FIGS. 5 and 6, and rotating connection 559 also has additional advantages that enable a resulting care operation substantially identical to that of the preferred embodiment (shown in FIGS. 1 through 4).

More particularly (referring still to FIGS. 7 and 8, rotor arm 560 is rigidly connected to rotatable drum 574 and is pivotally engaged around shaft 515, rotor arm 560 having a journal (not numbered) through which shaft 515 is engaged. Shaft 515 is also provided with a large notch 575 in the right longitudinal end of shaft 515, which right longitudinal end is pivotally engaged through rotating connection 559. The pivotal engagement between shaft 515 and rotor arm 560 is such to enable electrical communication between shaft 515 and rotor arm 560, and shaft 515 is further in electrical communication with the positive post of AC power supply 190 (represented schematically in FIG. 4). Rotatable drum 574 pivots about the axis of shaft 515 with respect to housing 571, but friction screws 576 through 578 prevent rotatable drum 574 from pivoting freely. Rather, friction screws 576 through 578 restrict the pivoting of drum 574 so that the rotation of drum 574 is quite dampened. This dampening drum 574 is for stopping the pivoting of drum 574 virtually immediately when the forces which cause the pivoting of drum 574 are ceased. When shaft 515 rotates, the circumferential edges of notch 575, which circumferential edges are adjacent the journal of rotor arm 560, eventually engage with tooth 579 of rotor arm 560. This engagement between the circumferential edges of notch 575 and tooth 579 enables the conveyance of pivotal forces from shaft 575 to rotor arm 560. Thereby, the rotation of shaft 515 causes the pivoting of rotor arm 560 about the longitudinal axis of shaft 515 and with respect to housing 571.

Rotor arm 560 is composed of an electrically conductive material and also has electrical contact 580, integrally formed with rotor arm 560 at the outer end of rotor arm 560. Electrical contact 580 is spring biased by rotor arm 560 to slideably engage arc-shaped strip 570 as well as contacts 562 through 565. Each of contacts 562 through 565 is in electrical communication with an electrically conductive line 566 through 569 respectively. Each of electrically conductive lines 566 through 569 is in electrical communication with electrical components 64, 50, 280, 130, 40, and 600 as schematically represented in FIG. 4 (omitting motor 87 represented in electrical communication with line 569). Electrical contacts 562 through 565 are integrally formed with housing 571; however, electrical contacts 562 through 565 are electrically insulated with respect to housing 571 by electrically insulative strip 570 which is adjacent each of electrical contacts 562 through 565. Housing 571 is rigidly connected to support 514 with brackets 572 and 573; and rotor arm 560, accordingly, pivots about the axis of shaft 515 with respect to housing 571.

The rotation of the rotor arm 560 of the rotating electrical connection 559 completes electrical circuits between shaft 515 and contacts 562 through 565. This completion of electrical circuits with contacts 562 through 565 sequentially controls the actuations of valve 50, valve 64, flush solenoid 280 (connected as shown in FIG. 1), and the simultaneous actuation of compressor 40 and the operation of heating element 130.

The operation of the rotating electrical connection 559 with respect to the pivoting of lid 513 is similar to the pivoting of lid 513 in the alternative embodiment pictured in FIGS. 5 and 6. Rotating electrical connection 559 is incorporated in an apparatus which includes means for manually pivoting nozzles 56 and 75 beneath the user's body by pivoting lid 513 through a nozzle pivoting range of positions of lid 513. When lid 513 is pivoting within the nozzle pivoting range of lid 513, rotor arm 560 is pivoted from its forwardmost, first position 581 (shown in hidden line) to the position 582 shown in FIG. 7. When rotor arm 560 is pivoted by the rotation of shaft 515 to a position in which contact 580 contacts contact 562, valve 50 is actuated for providing the flow of a cleansing solution through port 57 onto the user's crotch area when nozzle 56 is positioned beneath the user's crotch. Similarly, the pivoting of rotor arm 560 by the rotation of shaft 515 engaging tooth 579 enables the respective operations according to the electrical circuit completed between contact 580 and contacts 563, 564, and 565, appropriately. Thus, the rearwardly forcing edge 583 of notch 575 causes the completion of electrical circuits between shaft 515 and contacts 562 through 565, sequentially. This sequential completion of electrical circuits with contacts 562 through 565 controls the sequential actuations of valve 50, valve 64, flush solenoid 280 (connected as shown in FIG. 1), and the actuation of compressor 40 with the simultaneous operation of heating element 130.

When the user of this alternative embodiment of the present invention removes his body from seat 20', torsional spring 518 (shown in FIG. 6) along with gravitational force returns seat 513 to the half-closed position of seat 513; and the resetting edge 584 of notch 575 is engaged with tooth 579, and the further movement of lid 513 toward the half-closed position of lid 513 causes the pivoting of rotor arm 560 toward the initial position 581 of rotor arm 560.

Thus, the manually operable functions of the alternative embodiment shown in FIGS. 5 and 6, being the pivoting of nozzles 56 and 75 beneath the user's crotch and the actuation of valve 69' for generating the warm water source 62 are combined with the cleansing, rinsing, blow drying, and flushing functions of the preferred embodiment of the present invention. These functions are accomplished by the incorporation of rotating connection 559 instead of lever 532 in the alternative embodiment of FIGS. 5 and 6 while also operatively including the appropriate means for providing cleansing fluid, providing rinsing fluid, providing compressed heated air, and actuating the flush handle as in the preferred embodiment of FIGS. 1 through 4.

Yet another alternative embodiment (not shown) of the present invention substitutes a timer-like control mechanism for buttons 153 through 158 of the preferred embodiment shown in FIGS. 1 through 4. Thus, the sequential depression of buttons 153 through 158 is replaced by a timer that appropriately controls the operation of electrical components 69, 64, 50, 86, 280, 40, 130, 87 and the solenoid of the blower detent means, which operations are controlled by buttons 153 through 158 in the preferred embodiment of the present invention. The timer sequentially operates such electrical components in a sequence of respective durations that are predetermined through experimentation to be ideal. Accordingly, after testing the temperature of the water blowing through orifice 82, the user of the apparatus of this alternative embodiment of the present invention merely initiates the operation of the timer. The cleansing, rinsing, drying, and flushing cycles of the operation of the present invention are controlled by the timer until their appropriate predetermined durations are complete.

Additionally, although the present invention has been characterized in terms of the foregoing preferred embodiment, many other alterations, variations and modifications will be apparent to those of ordinary skill in the art who have the benefit of this disclosure. The invention is not limited by the above described preferred embodiment, and the characteristics of such skilled observations are intended and expected to be encompassed within the spirit and scope of the following claims.

We claim:

1. An apparatus for use in conjunction with means for receiving bodily excretions, such as a toilet, for removing waste products from the surface of a body after the excretion of said waste products, comprising:

a support structure;

means for directing a solution onto the surface of a body, said directing means being connected to said support structure and comprising a tube which encloses a fluid passage in fluid communication with a pressurized supply of the solution for directing the solution through an exit end of the tube onto the body surface; and means for pivoting said tube with respect to said support structure in an oscillatory manner such that the solution is directed onto the body surface along an arc traversed by the exit end of said tube, said pivoting means being operatively connected between said tube and said support structure;

said pivoting means comprising:

a shaft which is linked with said tube in a manner such that the position of the exit end of said tube correlates with the orientation of said shaft;

an electric motor for rotating said shaft;

a rotating electrical contact attached to said shaft wherein said rotating contact is electrically connected to the power terminal of said motor so as to cause the operation of said motor when said rotating contact is connected to an electric power source; and an annularly-shaped contact positioned to engage said rotating contact during rotation thereof, said annularly-shaped contact being electrically connected to said electric power source but having a discontinuity at a certain point thereof, wherein said rotating electrical contact makes an electrical connection with said annularly-shaped contact as said rotating contact rotates along with said shaft of said electric motor except when said rotating contact rotates to said discontinuity, said electrical connection completing a first electrical pathway for causing operation of said motor;

said annularly-shaped contact being positioned relative to said shaft such that said first pathway is completed except when the rotation of said shaft corresponds with a retracted position of the exit end of said tube.

2. The apparatus of claim 1, wherein:

said pivoting means further comprises contact means for selectively providing power to said motor by a second electrical pathway in parallel to said first electrical pathway.

3. The apparatus of claim 2 wherein the retracted position of the exit end of said tube is such that the exit end does not interfere with excretion of bodily waste products when operation of said electric motor ceases.

4. The apparatus of claim 2 wherein said tube includes an electrically-actuable valve which either enables or disables flow of the solution therethrough from the pressurized supply source.

5. The apparatus of claim 1 wherein said tube further comprises:

a vertically oriented, rigid segment rotatably mounted relative to the support structure;

such other segments in such number and in such orientation so as to direct the flow of the solution onto the body surface as said segments pivot about the axis about which said vertically oriented rigid segment is rotatably mounted.

6. The apparatus of claim 5 wherein:

said vertically oriented segment of said tube has a first lever rigidly connected thereto and projecting therefrom;

a second lever secured to said shaft and departing from the rotational axis of said shaft; and a connecting member linking said first lever to said second lever to translating rotational movement of said shaft and said second lever into pivotal movement of said first lever to pivot said vertically oriented segment.

7. The apparatus of claim 6 further comprising:

solenoid means connected to said tube in a manner such that the exit end of said tube is caused to pivot from the retracted position thereof when said solenoid means is actuated;

said connecting member being slidably connected to said second lever in such a manner as to allow a certain range of motion of said connecting member without causing rotation of said second lever; and detent means, integral with the end of said connecting member which is slidably connected to said first lever, for causing said connecting member to translate when said second lever rotates.

8. The apparatus of claim 6 wherein said solenoid means, when actuated causes the exit end of said tube to move to a position which directs the solution onto the body surface for enabling testing of the properties of the solution.

9. The apparatus of claim 1 wherein said tube is connected to spring means which causes the exit end of said tube to pivot to the retracted position when no other external torque is applied to said tube.

10. The apparatus of claim 1 further comprising solenoid means connected to said tube in a manner such that the exit end of said tube is caused to pivot from the retracted position thereof when said solenoid means is actuated.

11. The apparatus of claim 1 further comprising means for flushing waste products from a means for receiving bodily excretions, such as a toilet, with which the apparatus is utilized, said flushing means being actuated by solenoid means.

12. The apparatus of claim 1 wherein said solution is a cleansing solution, such as soap solution, for washing the body surface of waste products, further comprising: means connection to said support structure for directing a rinsing solution, such as water, onto the body surface in such a manner as to rinse the waste products and the cleansing solution from the body surface.

13. The apparatus of claim 1 further comprising means for directing compressed air onto the body surface in such manner as to evaporate the solution therefrom.

14. The apparatus of claim 13 further comprising an electrically actuable compressor for supplying compressed air to said compressed air directing means.

15. The apparatus of claim 1 further comprising a heating element for heating the solution as it flows through said tube.

* * * * *